US005610620A

United States Patent [19]

Stites et al.

[11] Patent Number: 5,610,620

[45] Date of Patent: Mar. 11, 1997

[54] COMBINATION ANTENNA

[75] Inventors: John Stites; David J. Holloway; Scott A. Caslow, all of Valencia, Calif.

[73] Assignee: Comant Industries, Inc., Santa Fe Springs, Calif.

[21] Appl. No.: 445,250

[22] Filed: May 19, 1995

[51] Int. Cl.[6] ..... H01Q 1/28; H01Q 5/01

[52] U.S. Cl. ..... 343/725; 343/700 MS; 343/708; 343/722

[58] Field of Search ..... 343/700 MS, 705, 343/708, 725, 722; H01Q 1/28, 23/00, 5/00, 5/01

[56] References Cited

U.S. PATENT DOCUMENTS

| | | | |
|---|---|---|---|
| 2,700,104 | 1/1955 | Bowman | 250/33 |
| 2,968,038 | 1/1961 | Hauptschein | 343/708 |
| 3,604,006 | 9/1971 | Rogers | 343/705 |
| 3,739,390 | 6/1973 | Poppe, Jr. et al. | 343/729 |
| 3,945,013 | 3/1976 | Brunner et al. | 343/708 |
| 4,008,479 | 2/1977 | Smith | 343/895 |
| 4,072,952 | 2/1978 | Demko | 343/700 MS |
| 4,083,050 | 4/1978 | Hall | 343/729 |
| 4,329,690 | 5/1982 | Parker | 343/709 |
| 4,392,139 | 7/1983 | Aoyama et al. | 343/705 |
| 4,635,066 | 1/1987 | St. Clair et al. | 343/705 |
| 4,868,577 | 9/1989 | Wingard | 343/725 |
| 5,057,848 | 10/1991 | Rankin et al. | 343/725 |
| 5,148,183 | 9/1992 | Aldama | 343/705 |
| 5,191,352 | 3/1993 | Bramson | 343/895 |
| 5,272,485 | 12/1993 | Mason et al. | 343/700 MS |
| 5,300,936 | 4/1994 | Izadian | 343/700 MS |

*Primary Examiner*—Michael C. Wimer
*Attorney, Agent, or Firm*—Edward Dreyfus

[57] ABSTRACT

A combination antenna for aircraft and the like capable of transmitting and receiving VHF signals and receiving GPS signals comprising a VHF monopole antenna assembly and a GPS patch antenna assembly located within a common aerodynamically shaped dielectric housing. Separate connectors connect coaxial cables to the two assemblies and assembly elements are provided to suppress cross coupling of signal harmonics and noise from the transmitted VHF signals to enhance isolation of the received signals for the GPS and VHF functions. No adding or separation of the VHF and GPS signal information is required and the low patch antenna profile enables a low and aerodynamically shaped antenna for the beneficial use on small aircraft.

10 Claims, 3 Drawing Sheets

COMBINATION ANTENNA

BACKGROUND

The present invention relates to antennas and more particularly to antennas capable of transmitting and receiving more than one frequency band designated by the FCC or other authority. Antennas incorporating the principles of the present invention have particular advantages for (1) simultaneous reception of 1575 MHz (GPS) signals and transmission/reception of 118–153 MHz (VHF) signals and (2) use on aircraft and other space borne vehicles.

Recent advancements in aircraft radio systems have given rise to the need for better communications in the GPS navigation and VHF data and voice communication systems. Traditionally, separate antennas were provided on aircraft designed to broadcast and receive these signals for coupling to separate on-board radio systems.

A need exists for a single antenna capable of such combination transmission for small aircraft and the like in order to minimize the use of space without detracting from the aerodynamic characteristics of the aircraft.

One antenna (commonly called the Dorne & Margolin DM CN 7-1/A) purports to provide combined GPS and VHF signal reception and includes a base plate and a whip-type VHF antenna extending rearward at a 60 degree angle from the base plate in an aerodynamically shaped housing surrounding the GPS/VHF assemblies. Means are provided for coupling both VHF and GPS signals to a common BNC connector mounted below the base plate.

Notwithstanding the purported dual transmission of GPS and VHF signals, this prior announced antenna would not be free of operational disadvantages. For example, the single BNC connector appears to be an advantage because fewer openings need be made in the aircraft skin and only one coaxial cable need be run to the connector. However, such design requires added electrical elements within the antenna itself and within the radio system to combine and then separate the various frequency signals transmitted through the single BNC connector.

Also, the internal components of the above mentioned antenna interact with and somewhat degrade the antenna transmission pattern.

Further, the leading portion of the above mentioned antenna includes a rather high profile thus reducing the aerodynamic characteristics of the antenna.

SUMMARY OF EXEMPLARY EMBODIMENT OF THE PRESENT INVENTION

A combination antenna according to the present invention comprises a patch antenna assembly functional in the GPS frequency band and a VHF whip antenna assembly functional in the VHF frequency band. These assemblies are housed within the same dielectric housing and are mounted to a common base plate. However, the radiation pattern of each assembly is essentially independent of the presence of each adjacent radiating structure. Electrical elements are provided to suppress cross coupling of VHF signals harmonics and noise that would otherwise interfere with the informational content of received GPS signals.

The low profile patch antenna assembly mounts ahead or forward of the VHF antenna assembly, thus enabling the outer dielectric housing to have a low profile which extends gracefully into the upstanding rear portion of the whip antenna.

Unlike prior purported combination antennas, no expensive filtering or combining elements need be provided to combine received signals for coupling to a common connector and then separating such signals once combined.

DRAWINGS

Various advantages, benefits, and enhancements compared to the prior art will become apparent with the following detailed description of an exemplary embodiment when taken in view of the appended drawings, in which, FIG. 1 is a side section of a combination antenna embodying the principles of the present invention.

DETAILED DESCRIPTION OF EXEMPLARY EMBODIMENT

Figure 1:
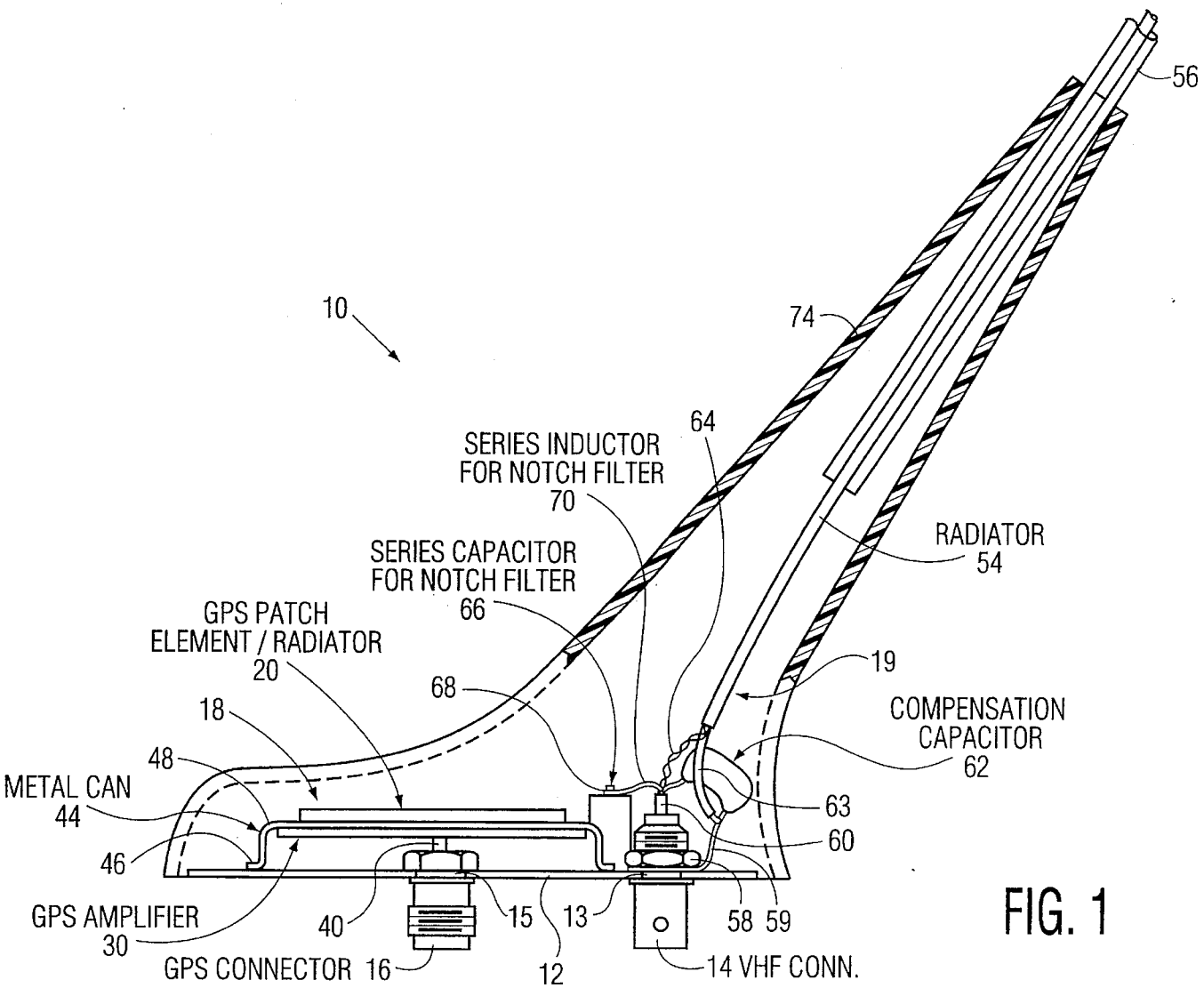
Figure 2:
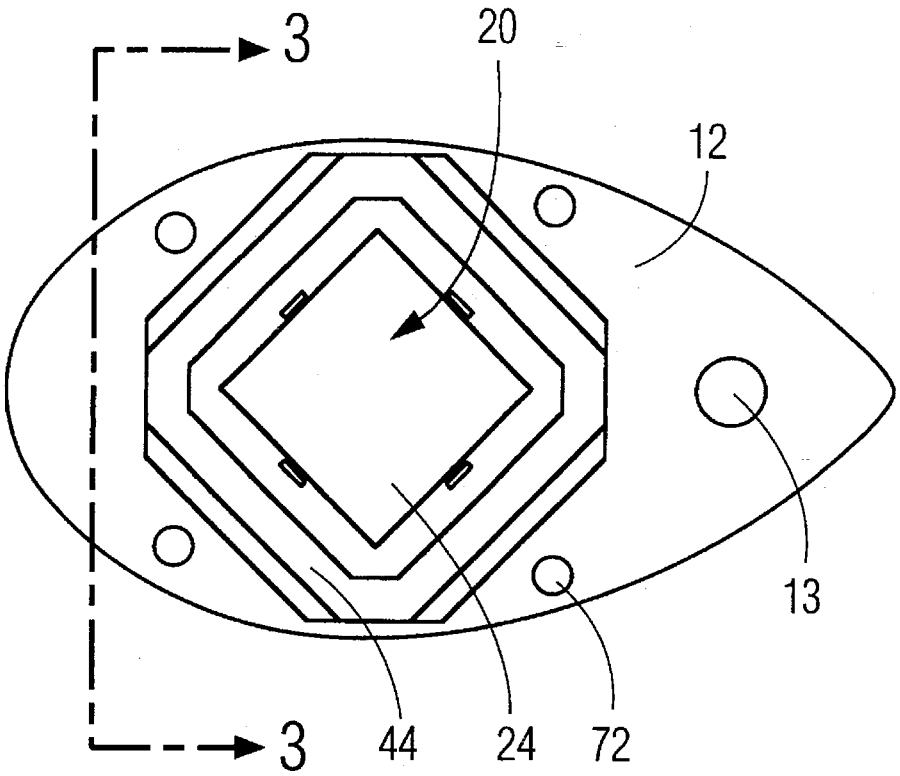
FIG. 2 is a plan view of the GPS antenna assembly mounted to the base plate.
Figure 3:
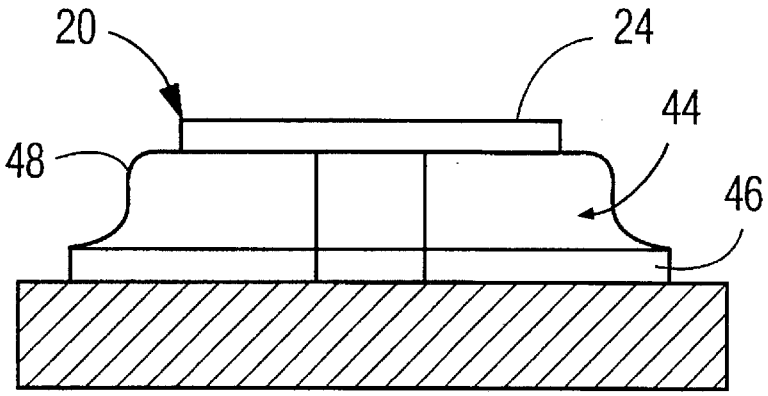
FIG. 3 is an enlarged side sectional view taken along line 3—3 of FIG. 2.

With reference to FIGS. 1–3, the combination antenna 10 comprises a tear-drop shaped metal base plate 12, a VHF connector 14 connected through opening 13 at its rear portion and a GPS coaxial cable connector 16 connected through opening 15 forward of and axially aligned with connector 14. Connectors 14 and 16 can be standard connectors for the signal frequencies coupled, respectively to separate coaxial cables, not shown. Base plate 12 mounts to the aircraft by four screw holes 72 through which four stainless steel knurled inserts connect the antenna to the aircraft and provide grounding connections to the aircraft.

The GPS patch antenna assembly 18 can be a standard configuration comprising a receiver element 20 that includes a generally square ceramic substrate having a gold film or layer 24 on the top receiver surface.

Assembly 18 further includes an amplifier 30 for GPS signals. Amplifier 30 can be standard and one of the well known designs with circuits and circuit elements easily incorporated on a printed circuit board using standard design techniques. Amplifier 30 functions as a pre-amplifier for the high frequency, low amplitude GPS satellite signals and should have some sensitivity to respond operationally to GPS frequency signals only. Pin 40 electrically connects amplifier 30 to GPS connector 16.

Metal, preferably brass, housing or can 44 functions to support radiator 20 on its top surface and amplifier 30 within and on the underside of its top. See FIG. 1. Amplifier 30 can be held to the underside of the can top by solder. Can 44 defines a mounting lip 46 for attachment, eg soldering, to base plate 12 and an upstanding housing portion 48.

The VHF antenna assembly includes a coaxial monopole radiator 54 extending upward and rearward from base plate 12 having a length preferably slightly greater than ¼ wavelength at center frequency. A dielectric housing 56 surrounds radiator 54 for most of its length. Compensation capacitor 62 has one lead electrically secured to terminal lug 59 which is secured by nut 58 on connector 14. The other lead of capacitor 62 is soldered to the center conductor 63. Radiator 54 center conductor 63 is soldered to the first mentioned lead of capacitor 62 and the shield 64 is soldered to center conductor 60.

A capacitor 66, mounted on and electrically connected to plate 12, and a wire 70 soldered to conductor 60 and terminal 68 form a series resonant notch filter at the GPS signal frequency. Thus, the series circuit formed by inductor 70 and capacitor 66 functions as an open circuit at the transmitted and received VHF signal frequency band and functions as a short circuit to ground (base plate 12) for received signals at the GPS frequency. Also, any harmonics of the VHF transmitted signals near the GPS frequency range shall be filtered to ground through these circuit elements.

An aerodynamic dielectric housing 74 surrounds the combination antenna assemblies and base plate 12. Housing 74 can be a molded shell, as shown, of filled with foam plastic or simply comprise molded foam plastic without an outside shell, as preferred. As seen in FIG. 1, the aerodynamic characteristics of the overall antenna low forward, then horizontal, then higher rearward profile is improved by the forward located GPS low profile patch antenna assembly.

Figure 4:
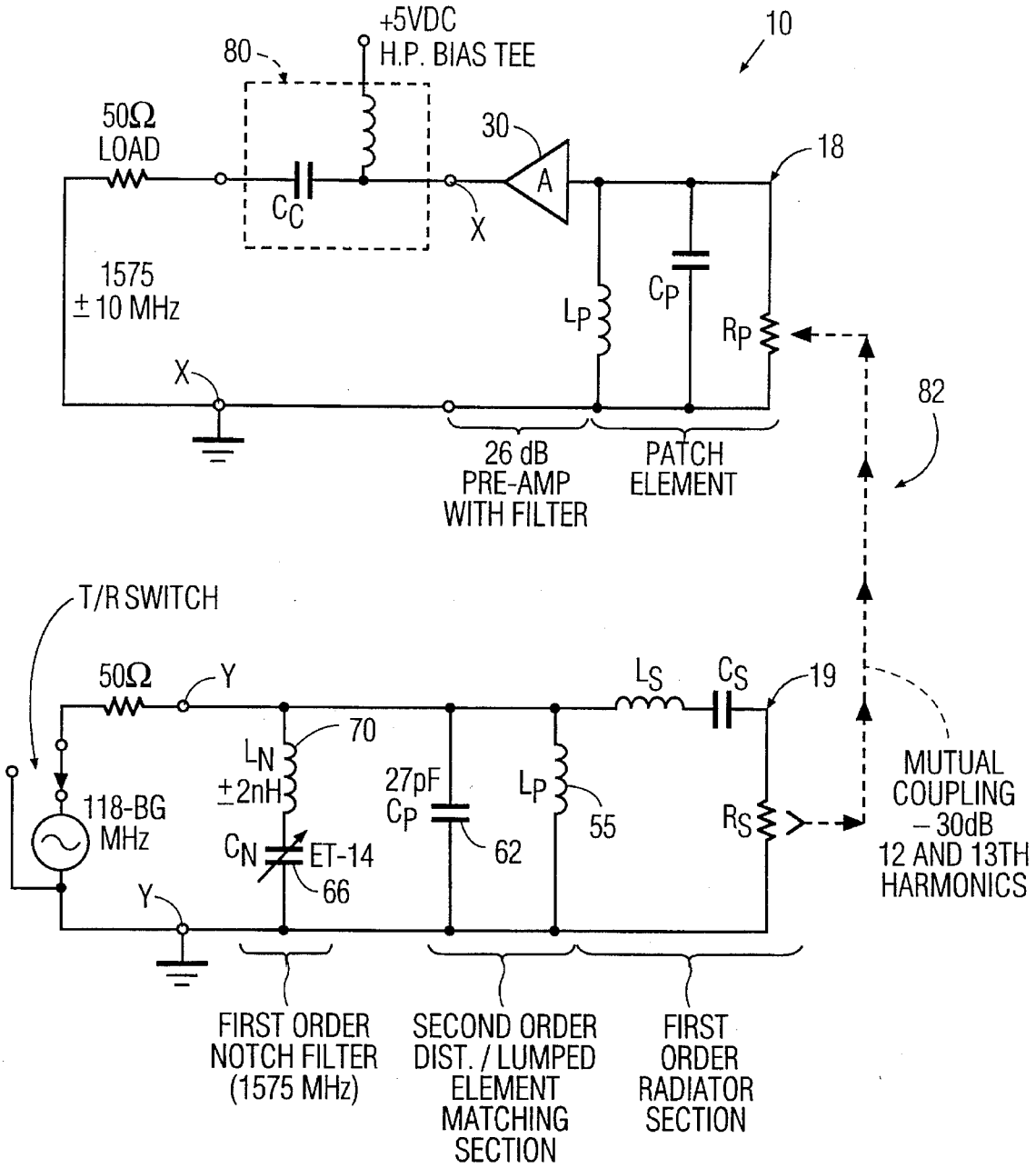
FIG. 4 is a simplified schematic of an equivalent circuit for the combination antenna 10 to illustrate certain principles of the present invention.

With reference to FIG. 4, there is shown the equivalent simplified schematic circuits for the GPS and VHF antenna assemblies 18 and 19, respectfully. Points x-x are the antenna connections for the GPS antenna 18 and y-y the antenna connections for VHF antenna 19. The power supplied is ±5 volts DC 80, is external to the antenna 10 and provides power for amplifier 30 while blocking DC from the load but enabling high frequency amplified signals to pass through to the load. L sub P, C sub P, and R sub P represent the lumped distributed elements of the patch antenna 18. GPS signals are received by the patch antenna, amplified by amplifier 30 and coupled to the load, eg the on-board radio receiver of the aircraft.

The on-board radio system also includes a standard VHF transmitter/receiver with a T/R switch depending upon the desired mode of operation. Antenna assembly 19 includes the wire inductor 70 and capacitor 66 forming the notch filter to ground VHF harmonics or other signals appearing on the antenna that is near the GPS frequency of 1575+ or −10 MHz. Capacitor C sub P comprises compensation capacitor 62 and parallel inductor L and P 55 comprises the distributed inductance of the whip VHF antenna. The series L, C and R sub S comprises the distributed values of the VHF antenna radiator 54.

Although mutual coupling, represented by 82 in FIG. 4, of electrical and/or electro-magnetic energy exists because of the proximity of the two antennas within housing 74, the effects of cross coupling are minimized by the notch filter formed by wire inductor 70 and series capacitor 66. In addition, because of the use of the notch filter and whip antenna, the radiation and receiving pattern of these antennas remain substantially independent of the internal component presence.

It will be understood that various modifications and changes can be made to the exemplary embodiment disclosed herein without departing from the spirit and scope of the present invention. It will also be understood that, although the embodiment disclosed herein relates to two specific frequency bands for use in aircraft, the inventive concepts can apply to other frequency bands for use in other types of vehicles, as well. Further, it will be understood that the drawings are not necessarily drawn to scale.

We claim:

1. A combination antenna for aircraft comprising, a substantially flat base plate having a forward portion and a rear portion, a first antenna assembly mounted above said rear portion of the base plate for transmitting and receiving first signals within a first operational bandwidth having a first center frequency, a patch antenna assembly mounted above said forward portion of the base plate for receiving second signals within a second operational bandwidth having a second center frequency, said first operational bandwidth including frequency having a harmonic component frequency that falls within said second operation bandwidth, said first antenna assembly comprising suppressing means for suppressing, from transmission by said first antenna assembly, signals having a frequency at said harmonic component frequency, said first antenna assembly comprising a first antenna and said patch antenna assembly comprising a patch antenna, and said patch antenna being longitudinally spaced from and completely forward of said first antenna.

2. An antenna according to claim 1, wherein said first center frequency is within the VHF band and said second center frequency comprises a GPS frequency.

3. An antenna according to claim 1, further comprising a coaxial cable connector mounted to and through the rear portion of said base plate for coupling signals to and from a coaxial cable and to and from said first antenna assembly, and a GPS coaxial cable connector mounted to and through said forward portion of the base plate for coupling GPS signals from said patch antenna assembly to a GPS coaxial cable.

4. An antenna according to claim 1, wherein said first antenna assembly comprises a compensation parallel inductor and a parallel compensation capacitor, and said suppressing means comprises a notch filter connected in parallel with said compensation capacitor and compensation inductor, said notch filter being tuned to short to the base plate signals having a frequency at said harmonic component frequency.

5. An antenna according to claim 4, wherein said first antenna assembly comprises a monopole, whip antenna extending upward and rearward from the base plate rear portion.

6. An antenna according to claim 5, wherein said base plate is tear-drop shaped with its center axis aligned with the longitudinal axis of said whip antenna.

7. An antenna according to claim 5, wherein the height of said patch antenna assembly above the base plate is lower than the height of said compensation capacitor and notch filter above said base plate.

8. An antenna according to claim 7, further comprising a dielectric housing having an aerodynamic shape and having a top profile extending upward from the plane of said base plate at a location forward from said patch antenna assembly, then extending substantially horizontally over a portion of said patch antenna assembly, then through an upward concave arc, then upward and rearward toward said whip antenna.

9. An antenna according to claim 1, wherein said patch antenna assembly comprises a metal housing mounted on said base plate and having a generally square profile in plan view and having a first diagonal diameter aligned with the center axis of said base plate and a second diagonal diameter extending perpendicular to said center axis.

10. An antenna according to claim 9, wherein said corners of said can are bevelled.

* * * * *

UNITED STATES PATENT AND TRADEMARK OFFICE

CERTIFICATE OF CORRECTION

PATENT NO. : 5,610,620

DATED : March 11, 1997

INVENTOR(S) : John Stites, et al.

It is certified that error appears in the above-indentified patent and that said Letters Patent is hereby corrected as shown below:

Col. 4, line 7, after "including" insert --a--.

Signed and Sealed this

Twenty-seventh Day of May, 1997

*Attest:*

*Attesting Officer*

BRUCE LEHMAN

*Commissioner of Patents and Trademarks*